US008380090B2

(12) United States Patent
Hanayama

(10) Patent No.: US 8,380,090 B2
(45) Date of Patent: Feb. 19, 2013

(54) PRINTER WHICH ALLOWS A USER TO SELECT WHETHER TO REUSE A SHEET OR TO PRINT ON A NEW SHEET AFTER A JAM HAS OCCURRED

(75) Inventor: Yukiyoshi Hanayama, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 374 days.

(21) Appl. No.: 12/748,653

(22) Filed: Mar. 29, 2010

(65) Prior Publication Data

US 2010/0278545 A1 Nov. 4, 2010

(30) Foreign Application Priority Data

Apr. 30, 2009 (JP) ..... 2009-110924

(51) Int. Cl.
*G03G 15/00* (2006.01)

(52) U.S. Cl. ..... 399/19; 399/18; 399/401

(58) Field of Classification Search ..... 399/18, 399/19, 401
See application file for complete search history.

(56) References Cited

U.S. PATENT DOCUMENTS

| | | | | |
|---|---|---|---|---|
| 7,018,120 | B2 * | 3/2006 | Takagi | 400/582 |
| 7,146,111 | B2 * | 12/2006 | Fujimoto et al. | 399/9 |
| 2004/0114945 | A1 | 6/2004 | Takagi | |
| 2006/0083568 | A1 * | 4/2006 | Takahashi | 399/401 |
| 2009/0094607 | A1 | 4/2009 | Indei | |

FOREIGN PATENT DOCUMENTS

| | | | |
|---|---|---|---|
| JP | 7-287425 | A | 10/1995 |
| JP | 8-069234 | A | 3/1996 |
| JP | 9-258516 | A | 10/1997 |
| JP | 2001-096871 | A | 4/2001 |
| JP | 2004-077760 | A | 3/2004 |
| JP | A-2007-248482 | | 9/2007 |
| JP | A-2007-307850 | | 11/2007 |
| JP | 2008-033169 | A | 2/2008 |
| JP | A-2008-284808 | | 11/2008 |
| JP | A-2009-76006 | | 4/2009 |
| JP | A-2009-93337 | | 4/2009 |

OTHER PUBLICATIONS

Translation of JP 2007-307850 to Kihara, Wataru published on Nov. 29, 2007.*

Japanese Official Action dated Feb. 22, 2011, issued in the counterpart Japanese Patent Application No. 2009-110924, together with an English language translation.

Notification of Reasons for Refusal dated Jan. 19, 2012 from the Japanese Patent Office from related Japanese Application No. 2009-110924, together with an English-language translation.

(Continued)

*Primary Examiner* — Judy Nguyen
*Assistant Examiner* — Blake A Tankersley
(74) *Attorney, Agent, or Firm* — Scully Scott Murphy & Presser PC

(57) ABSTRACT

A printer includes a feed unit; an image forming unit, which executes double-side printing; an acceptance unit, which accepts an execution command of either continuation printing and reprinting if double-side printing is stopped and a first recording medium with only a first side image printed thereon exists in the conveying path of the printer; and a control unit, which prints only the unprinted second side image, if a continuation printing command is entered and the control unit reprints the first side image on a second recording medium and also prints the unprinted second side image on the second recording medium, if a reprinting command is entered.

7 Claims, 5 Drawing Sheets

OTHER PUBLICATIONS

Notification of Reason for Refusal mailed Dec. 7, 2010 in corresponding Japanese Patent Application No. 2009-110924, together with English language translation.

Official Action dated Jun. 14, 2011 from the Japanese Patent Office from related Japanese Application No. 2009-110924, together with an English-language translation.

* cited by examiner

PRINTER WHICH ALLOWS A USER TO SELECT WHETHER TO REUSE A SHEET OR TO PRINT ON A NEW SHEET AFTER A JAM HAS OCCURRED

CROSS REFERENCE TO RELATED APPLICATION

The present application claims priority from Japanese Patent Application No. 2009-110924, which was filed on Apr. 30, 2009, the disclosure of which is incorporated herein by reference in its entirety.

BACKGROUND

This invention relates to a printer and more particularly to a printer having a double-side print function.

Hitherto, a printer has been known that when an anomaly, such as a jam, etc., occurs during printing and the printing operation is stopped, the user opens a cover, etc., and removes the sheet remaining in a conveying passage and then the printer prints on a new sheet. Further, a printer has been known that when an anomaly occurs during double-side printing and the printing operation is stopped, if a sheet in a conveying passage has only been printed on one side, the printer coveys the sheet and prints on the other side after anomaly recovery (without allowing the user to remove the sheet from the conveying passage).

SUMMARY

In the latter printer, the sheet with only one side printed can be reused. However, for example, when printing is stopped, if the sheet is wrinkled, etc., reuse of the sheet with one side printed may be undesirable and it is difficult for the conventional printer to print in response to such user's intention.

In view of the circumstances described above, it is an object of exemplary embodiments of the present invention to provide a printer that can execute printing responsive to the user's intention after double-side printing is stopped.

To accomplish the object, a printer according to the exemplary embodiment of the invention includes:

a feed unit where a plurality of recording media are set;

an image forming unit, which executes double-side printing by printing a first side image on a first side of a first recording medium selected from the plurality of recording media fed from the feed unit and conveyed along a conveying passage and then printing a second side image on a second side of the first recording medium;

an acceptance unit, which accepts an execution command of at least one of either continuation printing and reprinting if the first recording medium is in the conveying passage and has only the first side image already printed when double-side printing is stopped; and a control unit, which executes selection print processing of printing only the unprinted second side image, which corresponds to the first side image already printed on the first recording medium if the execution command of continuation printing is entered in the acceptance unit, wherein the control unit executes selection print processing of reprinting the first side image, which was previously printed on the first recording medium, on a second recording medium selected from the plurality of recording media and also the printing of the unprinted second side image on the second recording medium, if the execution command of reprinting is entered.

A printer according to the exemplary embodiment of the invention includes:

an image forming unit for performing a double-side printing process, the double-side printing process including printing a first image on a first side of a sheet and then printing a second image on a second side of the sheet;

an input unit for receiving a signal;

a control unit coupled to the image forming unit and the input unit;

wherein if the double side printing process is terminated after printing the first image on the first side of the sheet and before printing the second image on the second side of the sheet, and the double side printing process is restarted, the controller controls the image forming unit to restart double-side printing process from printing the first image if the controller receives a first signal from the input unit, and the controller controls the image forming unit to restart double-side printing process from printing the second image if the controller receives a second signal from the input unit.

DETAILED DESCRIPTION OF EXEMPLARY EMBODIMENTS

Embodiment 1

Next, a first embodiment of the invention will be discussed with reference to FIGS. 1 to 4.

(Internal Configuration of Printer)

Figure 1:
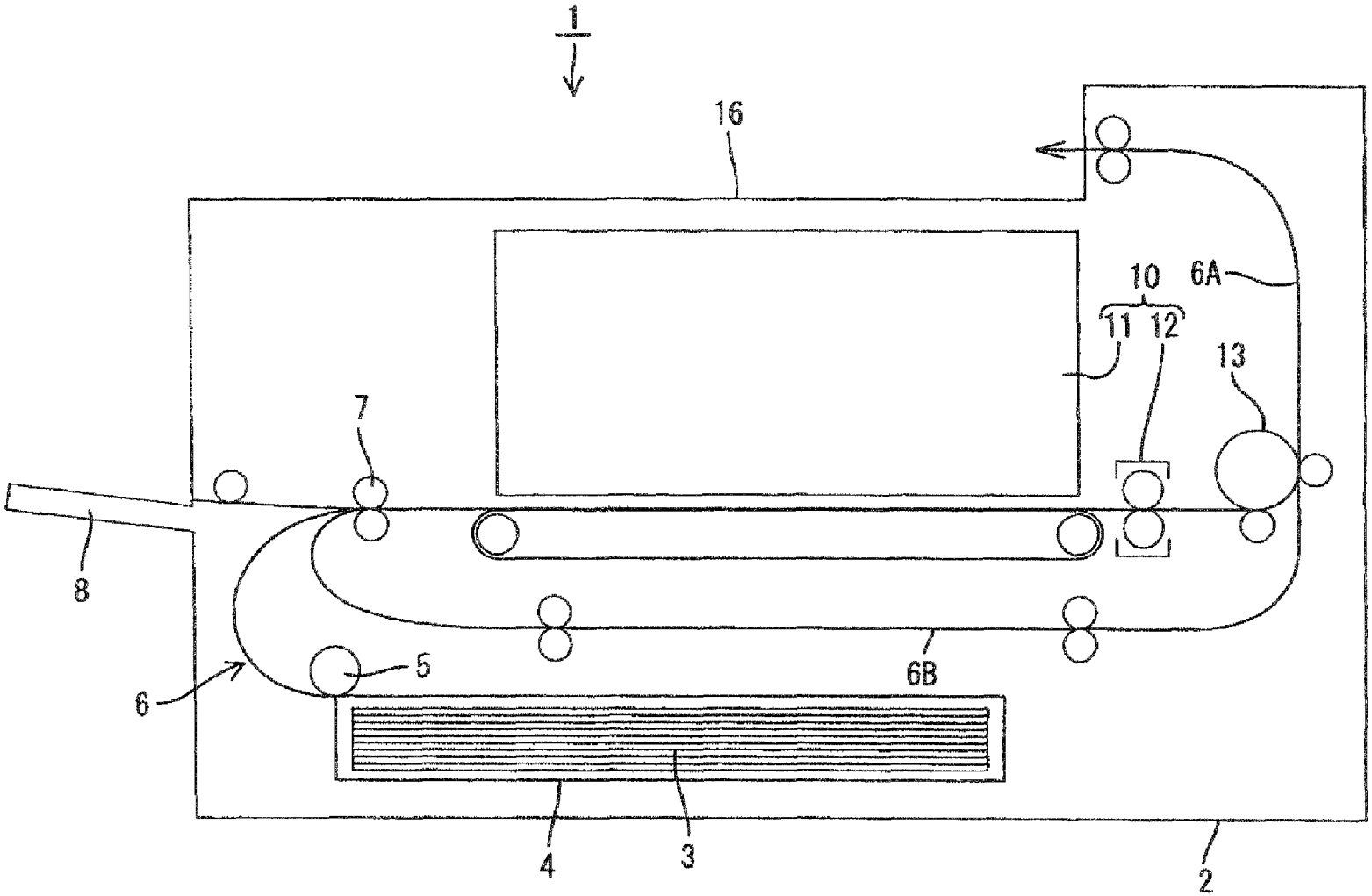
FIG. 1 is a schematic drawing showing the internal configuration of a printer according to a first embodiment of the invention.

FIG. 1 is a schematic drawing to show the internal configuration of a printer 1 of the first embodiment of the invention. In the following description, the left of FIG. 1 is considered the front.

As shown in FIG. 1, the printer 1 includes a sheet feed tray 4 (an example of feed unit) where a plurality of sheets 3 (an example of recording media) can be stacked at a bottom of a printer main body 2. One of the sheets 3 stacked in the sheet feed tray 4 is delivered to a conveying passage 6 by a sheet feed roller 5 and is conveyed to an image forming unit 10 by a registration roller 7. An MP (Multi Purpose) tray 8 (an example of feed unit), where a plurality of sheets 3 can be stacked, is provided on the front of the printer main body 2, and a sheet 3 delivered from the MP tray 8 is also conveyed to the image forming unit 10 by the registration roller 7.

The image forming unit 10 forms an image using known electrophotography and the image forming unit 10 has a process unit 11 and a fixing unit 12. The process unit 11 has an exposure unit, a photoconductive body, a developing unit, and a transfer unit (not shown), etc. At the printing time, the exposure unit exposes the surface of the photoconductive body to form an electrostatic latent image and the developing unit develops the electrostatic latent image to form a toner image. Further, the transfer unit transfers the toner image onto the sheet 3 and the fixing unit 12 fixes the toner image.

An inversion roller 13, which can rotate forward and backward, is provided downstream from the fixing unit 12. At the time of single-sided printing, a sheet 3 with an image formed on one side in the image forming unit 10 is sent to a discharge passage GA at the back of the printer by the inversion roller 13 and is discharged from the discharge passage 6A onto a discharge tray 16 provided on the upper face of the printer main body 2. At the time of double-side printing, a sheet 3 with an image formed on one side in the image forming unit 10 is conveyed to the discharge passage 6A and is then sent to a re-conveying passage 6B by backward rotation of the inversion roller 13. The sheet 3 is again conveyed from the re-conveying passage 6B to the image forming unit 10 with the sheet 3 being turned upside down by the registration roller 7, and an image is formed on the other side of the recording medium in the image forming unit 10. The sheet 3 with both sides thus printed is discharged onto the discharge tray 16 through the discharge passage 6A. In the following description, the earlier printed side of the sheet 3 conveyed at the double-side printing time is also called the first side and the later printed side is also called the second side.

A plurality of covers such as a front cover, a rear cover, and a top cover (not shown), which can be opened and closed, are provided on the outer face of the printer main body 2. At the jam handling time, any cover can be opened to take out the sheet 3 remaining in the conveying passage 6.

(Electric Configuration of Printer)

Figure 2:
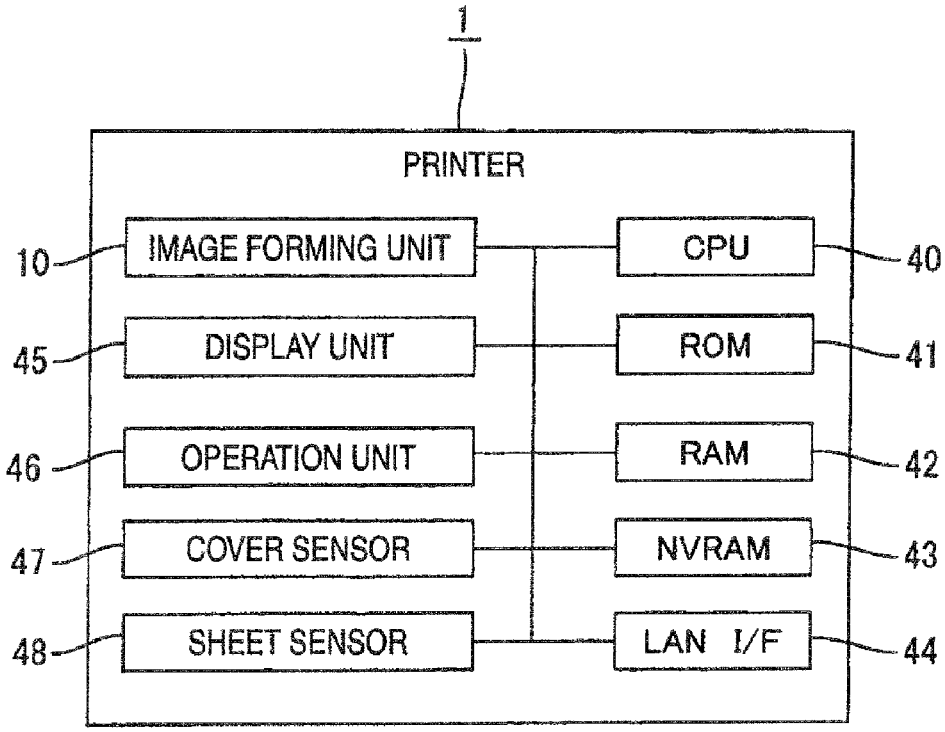
FIG. 2 is a block diagram schematically showing the electric configuration of the printer.

FIG. 2 is a block diagram schematically showing the electric configuration of the printer 1.

As shown in the figure, the printer 1 includes a CPU 40, ROM 41, RAM 42, NVRAM (nonvolatile memory) 43, and a network interface 44.

The ROM 41 stores programs for executing various types of operations of the printer 1, such as both-sided print processing described later. The CPU 40 (an example of a control unit) controls the units while storing the processing result in the RAM 42 or the NVRAM 43 in accordance with the program read from the ROM 41. The network interface 44 is connected to an external computer (not shown), etc., through a communication line, whereby the printer and the external computer, etc., can conduct data communications with each other.

The printer 1 also includes a display unit 45 and an operation unit 46. The display unit 45 (an example of a first notification unit, a second notification unit, a third notification unit, a fourth notification unit, etc.) includes a touch panel, a lamp, etc., and can display various set screens, e.g. the operation state of the printer, etc. The operation unit 46 (an example of an acceptance unit) includes the above-mentioned touch panel and buttons and can accept input of various commands of the user. The printer 1 further includes a plurality of cover sensors 47 for detecting the open/closed state of each of the covers, a plurality of sheet sensors 48 placed at points on the conveying passage 6 for detecting the presence or absence of a sheet 3, and the like.

(Double-Side Print Processing)

Figure 3:
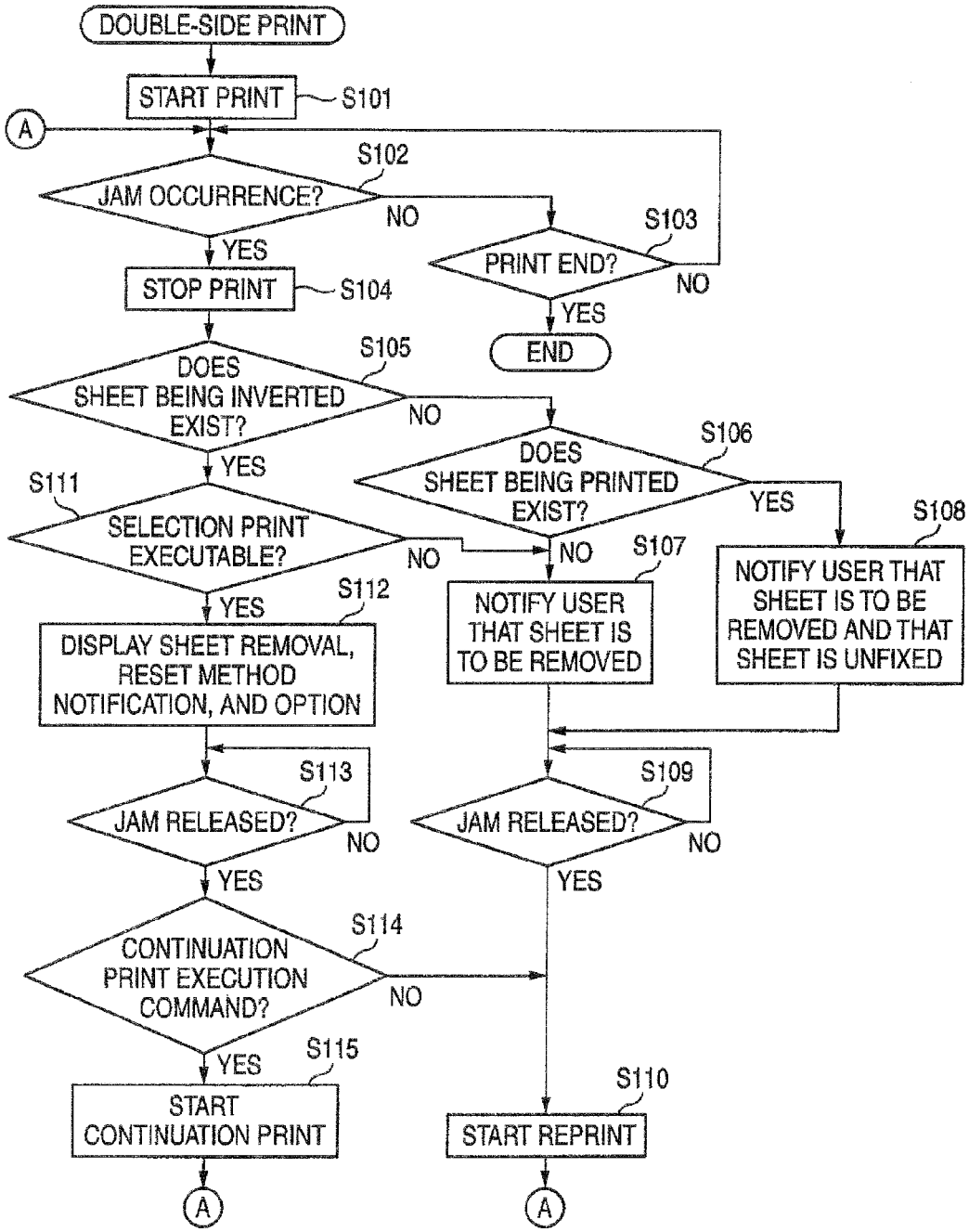
FIG. 3 is a flowchart showing double-side print processing.
Figure 4:
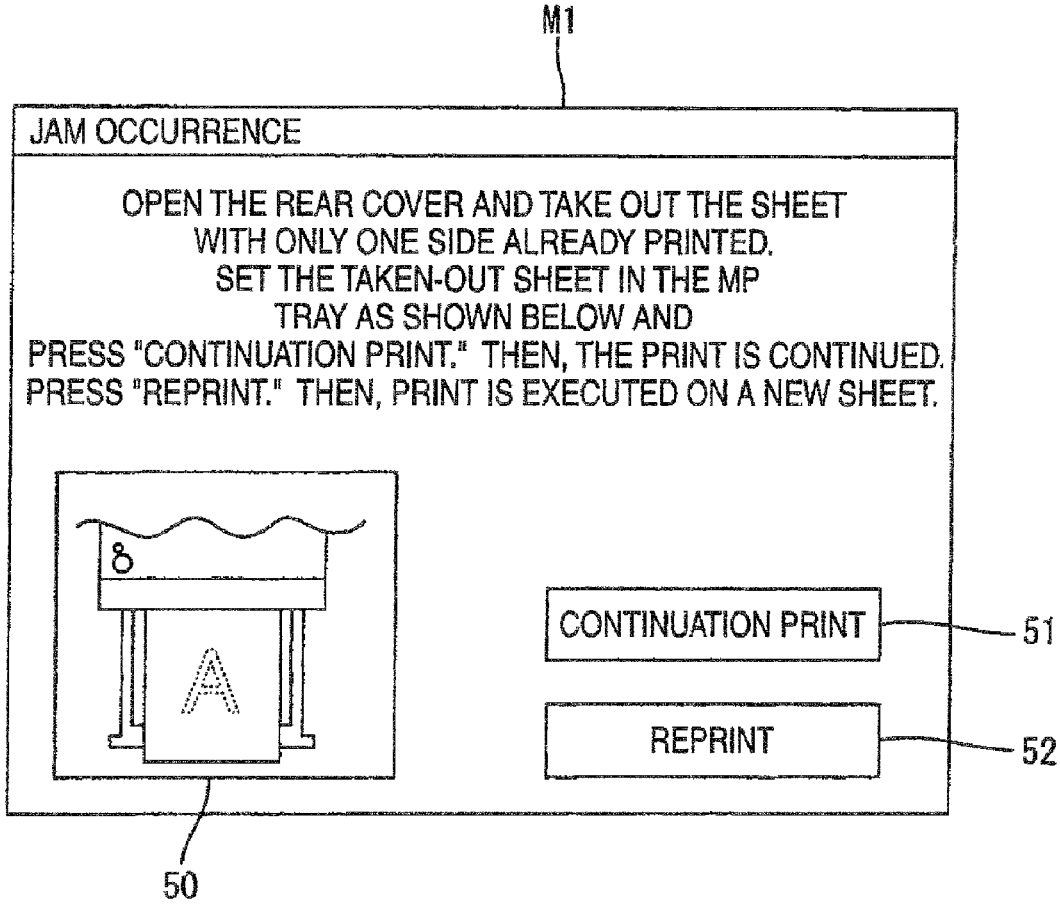
FIG. 4 is a drawing showing an example of a display screen displayed on a display unit.

FIG. 3 is a flowchart showing double-side print processing and FIG. 4 shows an example of a display screen M1 displayed on the display unit 45.

The double-side print processing is executed when a print request for double-side printing is transmitted from an external computer, etc., and is received through the network interface 44.

In the double-side print processing shown in FIG. 3, the CPU 40 first delivers one sheet 3 from the sheet feed tray 4 and starts printing (5101). In the double-side print processing of the embodiment, to print on a plurality of sheets 3, one sheet 3 is delivered from the sheet feed tray 4 and after printing on both sides of the sheet 3 is completed and the sheet 3 is discharged, another sheet 3 is delivered. The CPU 40 monitors jam occurrence at regular time intervals during the printing operation (S102).

For example, when a sheet 3 being conveyed is not detected within a predetermined time period by any sheet sensor 49, it is determined that a sheet (paper) jam has occurred. If the cover sensor 47 detects any cover being opened during the printing operation or if any other anomaly occurs, the CPU 40 determines that a jam has occurred. When all processing based on the print request is complete (YES at S103) without the occurrence of a jam (NO at S102), the double-side print processing is completed.

When a jam occurs during the printing operation (YES at S102), the CPU 40 stops the printing operation and also stops the conveying of the sheet 3 (S104). Subsequently, the CPU 40 determines whether or not an inverted sheet 3, i.e., whether a sheet 3 where printing of the first side has completed (passing through the fixing unit 12 inverted) before again arriving at the image forming unit 10, exists on the conveying passage 6 (S105). If an inverted sheet 3 does not exist (NO at S105), the CPU 40 determines whether or not a sheet 3 with the first side or the second side having been printed, i.e. a sheet 3 in a state before passing through the fixing unit 12 and after arriving at the image forming unit 10, exists (S106).

If a sheet 3 having been printed does not exist (NO at S106), namely, if a sheet 3, which has been delivered from the sheet feed tray 4 without having arrived at the image forming unit 10 or a sheet 3 with both sides printed and having passed through the fixing unit 12 exists along the conveying passage 6, the user is notified that a jam has occurred and the sheet 3 on the conveying passage 6 should be removed (S107). Here, for example, a message indicating useful information for the user to release the jam, such as the position of the sheet 3 along the conveying passage 6 and the position of the cover to take out the sheet 3, is displayed on the display unit 45, e.g. "Jam occurrence: Open the front cover and take out the sheet."

If a sheet 3 being printed exists on the conveying passage 6 (YES at S106), the user is notified that a jam has occurred, the sheet 3 in the printer should be removed, and that the removed sheet 3 is unfixed (S108). Here, the possibility that toner in an unfixed state may be deposited on the taken-out sheet 3 being printed is high and thus a message indicating that the sheet is not appropriate for continuation printing described later or that the sheet should be discarded without being reused may be displayed on the display unit 45.

After notifying the user that the sheet 3 should be removed, etc., at S107 or S108, the CPU 40 waits for release of the jam state (S109). Here, for example, if the cover sensor 47 detects the cover being closed after being opened or if the sheet sensor 48 detects removal of the sheet 3 on the conveying passage 6, it is determined that the jam is released. It may be determined that the jam is released based on input of the user meaning that releasing of the jam is complete through the operation unit 46.

When the jam state is released (YES at S109), the CPU 40 delivers a sheet 3 from the sheet feed tray 4 and starts reprinting (S110) and returns to S102. In the reprint, the image of the page printed on the sheet 3 removed from the conveying passage 6 or the image of the page that should be printed is printed on each side of the sheet 3 delivered from the sheet feed tray 4. Then, if a remaining print page exists, subsequently printing is executed on a sheet 3 delivered from the sheet feed tray 4.

If an inverted sheet 3, i.e. a sheet 3 with only the first side, already printed exists on the conveying passage 6 (YES at S105) the CPU 40 determines whether or not selection printing is set to be executable (S111). The selection printing is a process of executing printing of either continuation printing or reprinting according to user selection. The continuation printing is processing to print on the other side using the sheet 3 with only one side already printed, taken out from the printer at the time of jam occurrence. The CPU 40 can execute a set program in accordance with a previous command from the user and stores a setup value indicating whether or not selection printing is executable in the NVRAM 43 based on input from the operation unit 46 according to the setup program.

At S111, the CPU 40 checks the setup value stored in the NVRAM 43 and if selection printing is set to not execute (NO at S111) the CPU 40 goes to S107 and notifies the user that the sheet 3 should be removed, etc. In this case, after the jam state is released (YES at S109), reprinting is executed (S110) as described above. That is, the image of the page already printed on the first side of the taken-out sheet 3 and the image of the page that should be printed on the second side are both printed on a (new) sheet 3 fed from the sheet feed tray 4. Therefore, in this case, reprinting is executed without a user giving a reprint command.

If selection printing is set to be executable (YES at S111), for example, display screen M1, as shown in FIG. 4, is displayed on the display unit 45 (5112). The display screen M1 displays a message indicating that a jam occurs, that the sheet 3 on the conveying passage 6 should be removed, and the position of the cover to take out the sheet 3.

To execute continuation printing, the display screen M1 displays a method of setting the taken-out sheet 3 in the tray with a message and an instruction drawing 50. The instruction drawing 50 indicates that the taken-out sheet 3 (with only one side already printed) is to be set in the MP tray 8 (rather than the sheet feed tray 4), that the sheet 3 is to be set with the already printed side (upside) down, and that the sheet 3 is to be set in the portrait orientation relative to the drawing-in direction of the MP tray 8.

Further, the display screen M1 is provided with options 51 and 52 for the user to select execution of continuation printing or reprinting and enter an execution command.

Subsequently, the CPU 40 determines whether or not the jam state is released (the sheet 3 on the conveying passage 6 is removed) (S113). If the jam state is released (YES at 113) and an execution command of continuation printing is entered from the operation unit 46 (YES at S114), the CPU 40 delivers the sheet 3 set in the MP tray 8 and starts execution of continuation printing (S115) and returns to S102. In the continuation print, the image of the page that should be printed on the second side of the taken-out sheet 3 is printed on the sheet 3 delivered from the MP tray 8.

That is, when the user takes out the sheet 3 with only the first side already printed from the conveying passage 6 and then sets the sheet in the MP tray 8 and enters an execution command of continuation print, printing is continued on the second side of the sheet. Here, the user sets the taken-out sheet 3 in the MP tray 8 in accordance with the instruction of the display screen M1, whereby an image of the second side is printed on the correct side of the sheet 3 in the correct orientation.

After printing on the sheet 3 in the MP tray 8, if a remaining print page exists, the CPU 40 subsequently prints on a sheet 3 delivered from the sheet supply tray 4.

If the user enters an execution command to reprint in the display screen M1 (NO at S114), the process goes to S110 and reprinting is executed on a (new) sheet 3 delivered from the sheet supply tray 4. That is, when the user takes out the sheet from the conveying passage 6, if the user determines that continuation printing is not desired because of the circumstance of a wrinkle on the sheet 3, etc., the user can cause the printer to reprint without executing continuation printing.

Advantages of the Embodiment

As described above, according to the embodiment, when double-side printing is stopped, if the sheet 3 with only the first side already printed exists on the conveying passage 6, input of an execution command of continuation printing or reprinting is accepted. If an execution command for continuation printing is entered, printing is executed on the unprinted second side of the sheet 3 set in the MP tray 8; if an execution command of reprint is entered, printing is executed on the already printed first side and the unprinted second side.

According to the selection print processing, when double-side printing is stopped because of occurrence of a jam, etc., if the user takes out the sheet 3, which has only one side printing remaining, from on the conveying passage 6 and sets the sheet in the MP tray 8 and enters an execution command for continuation printing, printing can be executed on the other side. If the user determines that printing reusing the sheet 3 is not desired, for example, because of a wrinkle on the taken-out sheet 3, etc., the user enters an execution command for reprinting, whereby printing can be executed on a sheet 3 (different from the taken-out sheet 3) in the sheet feed tray 4. That is, the user takes out the sheet 3 with only one side already printed and then determines whether continuation printing using the sheet 3 or reprinting using another sheet 3 should be executed and printing responsive to the user intention can be executed.

The selection print processing can be set to be executable or not executable. If selection print processing is set to be not executable, print processing of executing reprinting on a sheet 3 in the sheet feed tray 4 is executed in a state in which an execution command is not entered using the operation unit 46. If the user does not want to execute selection print processing, i.e. selection print processing is set to be not executable, and reprinting will be executed without waiting for the user to enter an execution command, so that processing can be performed rapidly.

A plurality of sheet feed units (4 and 8) for feeding a sheet 3 to the image forming unit 10 are provided. When double-side printing is stopped, if the sheet 3 with only the first side already printed exists along the conveying passage 6, the user is notified of which of the plurality of sheet feed units (4 or 8) to set the sheet 3 removed from the conveying passage 6 in (4 and 8). Accordingly, continuation printing using the sheet 3 removed from the conveying passage 6 by the user can be performed smoothly.

When double-side printing is stopped, if the sheet 3 with only the first side already printed exists in the conveying passage 6, the user is notified of the orientation or direction (up, down, left, right, surface, back, etc.,) to set the sheet 3 in the MP tray 8. Accordingly, continuation printing using the sheet 3 taken out from the conveying passage 6 by the user can be performed smoothly.

The possibility that the sheet 3 being printed may be inappropriate for continuation printing is high. Thus, notification is provided by distinguishing from the case where the sheet 3 with only the first side already printed exists, whereby the user can take a proper step of discarding the taken-out sheet, etc., for example.

When a double-side printing sequence for a plurality of sheets 3 is stopped, if an execution command of continuation printing is entered in the operation unit 46, continuation printing is executed and then the remaining printing is executed. Accordingly, changing of the print order for a plurality of sheets 3 because of a print stop can be prevented.

Embodiment 2

Figure 5:
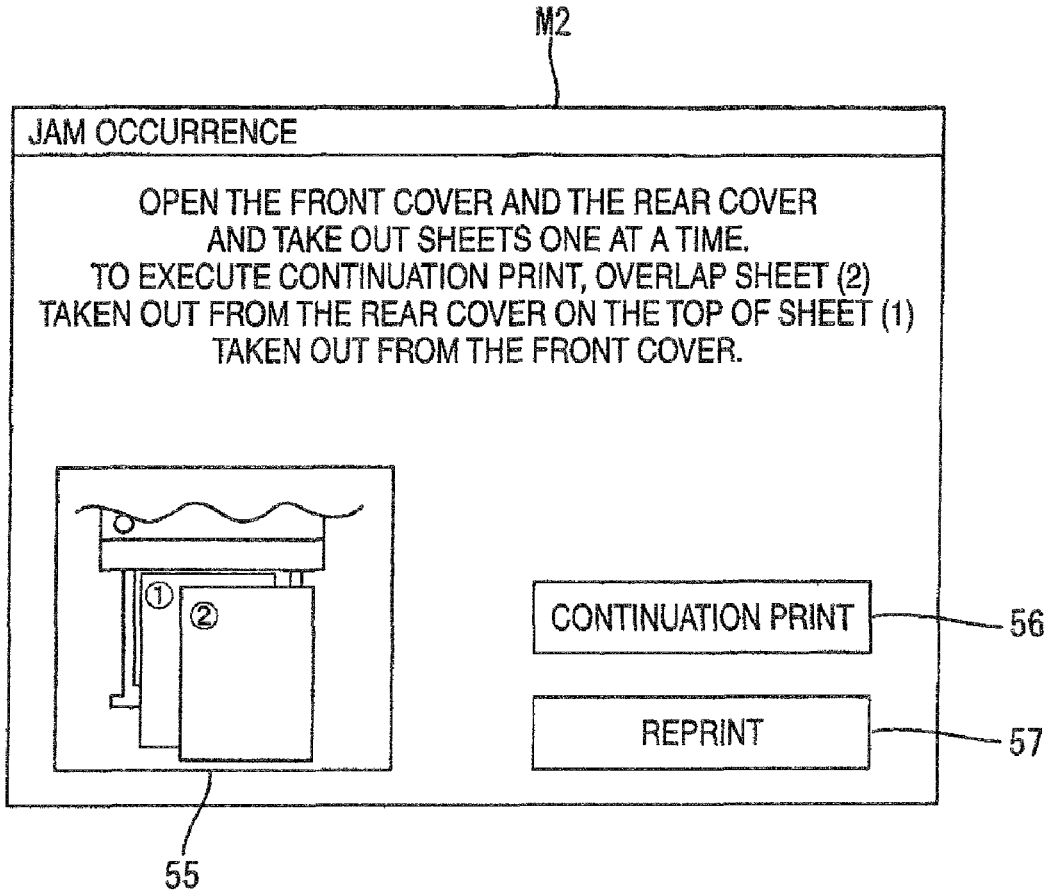
FIG. 5 is a drawing to showing an example of a display screen displayed on a display unit according to a second embodiment of the invention.

Next, a second embodiment of the invention will be discussed with reference to FIG. 5. FIG. 5 shows an example of a display screen M2 displayed on a display unit 45.

In the embodiment described above, only one sheet 3 remains in the conveying passage 6 when the jam occurs during double-side printing. In Embodiment 2, an operation example when there is a possibility that more than one sheet 3 may remain in the conveying passage 6 is shown. The schematic configuration of a printer 1 of Embodiment 2 is similar to that of Embodiment 1.

When a jam occurs during double-side print processing, a CPU 40 checks the state (position) of each sheet 3 along a conveying passage 6 and notifies the user of the position of each sheet 3, an unfixed state, etc., in response to the state of each sheet 3. FIG. 5 shows an example of the display screen M2 when there are two sheets 3 each with only one side already printed (2 sheets 3 being inverted).

The display screen M2 shows a message indicating that the two sheets 3 are to be removed, and the positions of the covers to take out the two sheets 3. Further, the display screen M2 shows the overlap order of the taken-out sheets 3 in the tray to execute continuation printing with a message and an instruction drawing 55. The display screen M2 is also provided with options 56 and 57 for the user to select execution of continuation printing or reprinting and enter an execution command.

When the user enters an execution command for continuation printing from an operation unit 46 on the display screen M2, the CPU 40 delivers two sheets 3, one at a time from the MP tray 8, and prints on the second side of each sheet 3. Here, the user sets the two sheets 3 on the MP tray 8 in an overlap manner in the order indicated on the display screen M2, whereby an image of the page corresponding to the page image already printed on the first side is printed on each of the second sides of the two sheets 3.

Thus, according to the embodiment, when double-side printing is stopped, if more than one sheet 3 with only the first side already printed exists along the conveying passage 6, the user is notified of the overlap order of the sheets 3 taken out from the conveying passage 6 on the MP tray. Accordingly, continuation printing using the sheets 3 taken out from the conveying passage 6 by the user can be performed smoothly.

Other Embodiments

It is to be understood that the invention is not limited to the above embodiments described with reference to the accompanying drawings and that the following embodiments, for example, are also contained in the technical scope of the invention:

(1) In the embodiments described above, the invention is applied to printers of direct transfer system by way of example, but the present invention can also be applied to printers of any other system such as intermediate transfer system, four-cycle system, or ink jet system, for example.

(2) In the embodiments described above, the user enters an execution command of either continuation printing or reprinting from the operation unit. However, according to the invention, if the user does not enter any command for a predetermined time from the operation unit, it may be assumed that an execution command of continuation printing or reprinting is entered, and the printing may be executed. For example, a tray sensor for detecting the presence or absence of a sheet in the MP tray may be provided and if the tray sensor detects a sheet, it may be assumed that an execution command of continuation printing is entered, and continuation printing may be executed; if a sheet is not detected for a predetermined time, it may be assumed that an execution command of reprinting is entered, and reprinting may be executed.

(3) When the user is requested to select execution of continuation printing or reprinting, print processing may be terminated according to the input of a cancel command by the user.

(4) In continuation printing, printing may be executed on a sheet fed from the same sheet feed unit as at the reprint time. In continuation printing, only the unprinted second side of a new sheet fed from the sheet feed unit may be printed without reusing the sheet with only the first side already printed.

(5) The mode in which the user is notified of various pieces of information can be changed as required. For example, information may be provided for the user by displaying text, a pattern, etc., on the display or by lighting a predetermined lamp. Further, information may be provided for the user by voice and a signal for providing such information may be transmitted to a computer, etc., through the network interface 44.

(6) In the embodiments described above, two sheet feed units are provided. However, according to the invention, the number of sheet feed units may be only one or may be three or more.

What is clamed is:

1. A printer comprising:

a feed unit configured to hold a plurality of recording media;

an image forming unit configured to execute double-side printing by printing a first side image on a first side of a first recording medium selected from the plurality of recording media fed from the feed unit and conveyed along a conveying passage and then printing a second side image on a second side of the first recording medium;

an operation unit configured to accept an execution command of at least one of either continuation printing and reprinting if the first recording medium is in the conveying passage and has only the first side image already printed when double-side printing is stopped;

a control unit configured to execute a first selection print processing of printing only the unprinted second side image, which corresponds to the first side image already printed on the first recording medium if the execution command of continuation printing is entered in the operation unit; and a notification unit;

wherein the control unit is further configured to execute a second selection print processing of reprinting the first side image, which was previously printed on the first recording medium, on a second recording medium selected from the plurality of recording media and also the printing of the unprinted second side image on the second recording medium, if the execution command of reprinting is entered, and wherein the control unit is configured to control the notification unit to notify a user of the overlap order in the feed unit of at least two recording media, which are removed from the conveying passage if the at least two recording media are in the conveying passage and each has only the first side image already printed thereon, when double-side printing is stopped, wherein if the execution command for continuation printing is entered in the operation unit, the control unit is configured to print on an unprinted second side corresponding to each of the already printed first sides of each of the at least two recording media based on the overlap order indicated by the notification unit.

2. The printer according to claim 1, wherein the operation unit is further configured to receive a selection of setting the first and second selection print processing to one of execute or not execute, wherein when double-side printing is stopped, and if the first recording medium is in the conveying passage and has only the first side image already printed on the first side, the control unit is configured to execute the first or second selection print processing if the first and second selection print processing is set to execute by the operation unit, and the control unit is configured to execute non-selection print processing of executing the reprinting on the second recording medium in a state that an execution command is not entered in the operation unit, if the first and second selection print processing are set to not execute by the operation unit.

3. The printer according to claim 1, wherein a plurality of feed units are provided in the printer, wherein the control unit is configured to control the notification unit to notify a user of to which of the plurality of feed units to set the first recording medium taken out from the conveying passage if the first recording medium is in the conveying passage and has only the first side image already printed on the first side, when double-side printing is stopped, wherein if the execution command of continuation printing is entered in the operation unit, the control unit is configured to execute continuation printing on the first recording medium set in the feed unit indicated by the notification unit.

4. The printer according to claim 1, wherein the control unit is configured to control the notification unit to notify a user of an orientation in which the first recording medium in the feed unit is to be set if the first recording medium is in the conveying passage and has only the first side already printed on the first side when double-side printing is stopped, wherein if the execution command of continuation printing is entered in the operation unit, the control unit is configured to print the unprinted second side image on the second side of the first recording medium, so that the second side image is printed in the orientation corresponding to the already printed first side image based on the orientation indicated by the notification unit.

5. The printer according to claim 1 wherein if there is the first recording medium in the conveying passage when double-side printing is stopped, the control unit is configured to determine if the first recording medium only has the first side image already printed and control the notification unit to notify a determination result to the user.

6. The printer according to claim 1, wherein when a sequence of the double-side printing for the plurality of recording media is stopped, if the execution command of continuation printing is entered in the operation unit for the first recording medium selected from the plurality of recording media, the control unit is configured to execute continuation printing for the first recording medium selected from the plurality of recording media and then execute the remaining printing for a portion of the plurality of recording media, which have not yet been printed.

7. A printer comprising:

a feed unit configured to hold a plurality of sheets;

an image forming unit for performing a double-side printing process, the double-side printing process including printing a first image on a first side of a sheet among the plurality of sheets fed from the feed unit and conveyed along a conveying passage and then printing a second image on a second side of the sheet;

an input unit for receiving a signal;

a control unit coupled to the image forming unit and the input unit, and a notification unit;

wherein if the double side printing process is terminated after printing the first image on the first side of the sheet and before printing the second image on the second side of the sheet, and the double side printing process is restarted, the control unit controls the image forming unit to restart double-side printing process from printing the first image if the control unit receives a first signal from the input unit, and the control unit controls the image forming unit to restart double-side printing process from printing the second image if the control unit receives a second signal from the input unit, wherein, if at least two sheets are in the conveying passage and the double side printing process is terminated after printing the first image on the first sides of each of the at least two sheets and before printing the second image on the second sides of the at least two sheets, the control unit controls the notification unit to notify a user of the overlap order in the feed unit of the at least two sheets which are removed from the conveying passage, and if the control unit receives the second signal from the input unit and the double side printing processing is restarted, the control unit prints on an unprinted second side corresponding to each of the already printed first sides of each of the at least two sheets based on the overlap order indicated by the notification unit.

* * * * *